United States Patent [19]

Negre et al.

[11] Patent Number: 4,506,636

[45] Date of Patent: Mar. 26, 1985

[54] DEVICE FOR CONTROLLING A GAS CIRCUIT OF A COMBUSTION CHAMBER AND A SEALING MEMBER FOR ITS OPERATION

[75] Inventors: Guy Negre, Vinon; Jean-Claude Fayard, Lyons, both of France

[73] Assignee: Elf France, Courbevoie, France

[21] Appl. No.: 517,030

[22] Filed: Jul. 25, 1983

[30] Foreign Application Priority Data

Jul. 27, 1982 [FR] France ..... 82 13071
Jul. 27, 1982 [FR] France ..... 82 13072

[51] Int. Cl.[3] ..... F01L 7/16

[52] U.S. Cl. ..... 123/190 A; 123/190 E; 123/65 VC

[58] Field of Search ..... 123/190 A, 190 R, 190 E, 123/73 A, 65 VC

[56] References Cited

U.S. PATENT DOCUMENTS 1,671,254 5/1928 Porter ..... 123/190 E
2,322,961 6/1943 Yingling ..... 123/65 VC
4,008,694 2/1977 Monn ..... 123/190 E

FOREIGN PATENT DOCUMENTS 340964 7/1904 France ..... 123/65 VC
891926 3/1944 France ..... 123/190 E
576222 5/1958 Italy ..... 123/190 E

*Primary Examiner*—Ronald H. Lazarus
*Attorney, Agent, or Firm*—Burgess, Ryan & Wayne

[57] ABSTRACT

Device for controlling the evacuation of exhaust gases of a combustion chamber in an internal combustion engine.

A rotary valve performs a continuous or alternate turning movement and synchronized with the rotation of the motor about an axis parallel to the axis of rotation of the motor and issues at the level of its transversal channel on one side on an orifice connected to the exhaust towards the outside.

The invention is applied to the control of the exhaust of two stroke engines.

17 Claims, 9 Drawing Figures

DEVICE FOR CONTROLLING A GAS CIRCUIT OF A COMBUSTION CHAMBER AND A SEALING MEMBER FOR ITS OPERATION

BACKGROUND OF THE INVENTION

The invention concerns a device for controlling a gas circuit especially for the evacuation of exhaust gas of a two stroke engine and an engine equipped with this device and a sealing element for a rotary valve in order to control the exhaust of engines such as two stroke or four stroke diesel or controlled firing internal combustion engines.

DESCRIPTION OF THE PRIOR ART

In two stroke engines of the known type, the exhaust of burned gases is carried out through a laterally positioned port in the cylinder and uncovered by the piston when it arrives at the end of the driving stroke.

The rigid positioning of this port determines an advance angle at the opening equal to the delay angle at the closing of the exhaust on either side of the end of the driving stroke, thus giving rise to drawbacks that are well known with this type of engine.

the difficulty in completely emptying the cylinders of burned gases and, especially, of those contained in the cylinder head, the exhaust port being positioned at the bottom of the cylinder;

the obligation of producing these exhaust systems at counter-pressure in order to prevent over evacuation of fresh gas at the exhaust;

the impossibility of causing the air feed system to function correctly over a broad range of rotational speeds. Since it only reaches its optimum at a frequency in harmony with the geometry of the exhaust;

loss of yield, considerable increase in fuel consumption through the evacuation of fresh gas at the exhaust or reaspiration of the burned gases according to the engine rating;

contact of the piston rings by hot exhaust gases that burn the oil and bring about the rubbing of the rings of the piston and a rapid clogging of the engine.

In order to overcome these drawbacks, especially for two stroke diesel engines, gas exhaust valves which improves the filling up of the cylinders have also been used, but they create fresh problems such as:

throttling the gases and considerable loss of charge;

high temperatures of the valves due to the two stroke cycle and great difficulties in cooling;

considerable knocking noise.

One of the aims of the present invention is to create a device allowing these drawbacks to be overcome, to considerably improve the yield of two stroke engines, to reduce the pollution that they provoke, especially by the rejection of unburned particles and oil, while remaining both easy and economical to manufacture.

SUMMARY OF THE INVENTION

With this in mind, in the control device for the evacuation of exhaust gases or the admission of fresh gas to a combustion chamber of an internal combustion engine, especially from a reciprocating or rotary piston two stroke engine constituted by a rotary valve comprising a rotor having a transverse flow channel, this rotary valve performing a continuous or oscillating turning movement synchronized with the rotation of the motor crank shaft arranged at the level of the channel, on the one side, with an orifice directly connected to the combustion chamber and, on the other side, with an orifice connected to the exhaust channel for the burned gases towards the exterior in order to alternately seal the orifice, then connect the combustion chamber to the exhaust, in synchronization with the respective phases of compression, then exhaust of the combustion chamber and the rotary valve being contained in a bore into which communicates with the orifice directly connected to the combustion chamber of the engine and the exhaust orifice connected to an exhaust collector, the cross-section of these orifices being generally different than the cross-section of the transverse channel of the rotary valve, according to a preferred embodiment of the invention, the orifice connected to the combustion chamber is arranged in a sealing ring housed in a bore and communicates with the rotary valve by the pressure prevailing in the combustion chamber and surrounded by one or several sealing elements such as rings, the rings being able to slide in the bore and its travel distance being limited, on the one side, by the rotary valve and, on the other side, by a retaining shoulder. The use of a metal sealing ring of good rubbing quality permits sealing of the exhaust, despite high temperatures of the exhaust gas.

According to two different embodiments of the engine, the rotary valve is driven at an angular speed of rotation equal to half the angular speed of the crankshaft of the engine, or further the rotary valve is driven in an alternative oscillating rotation movement at each turn of the engine by a mechanical coupling means with the crankshaft of the engine such as a driving rod, one of the ends of which is driven in rotation by the crankshaft of the engine, whereas the other is connected to the rotary valve.

In order to facilitate machining of the bore in a minimum number of passes and to improve the holding of the sealing ring, it is preferred that the diameter of the bore is larger than to the diameter of the connection orifice to the exhaust collector. The rotary valve or rotor comprises, preferably, at least one slot or an internal circuit surrounding its transverse channel for the circulation of a cooling fluid, in order to avoid seizing on contact with the sealing ring subject to the maximal pressure of the exhaust gases.

According to another embodiment of the invention, the section of the orifice provided in the sealing ring in contact with the rotary valve is equal or smaller in section than the channel provided in the rotary valve, at the end of the driving stroke of the piston closing the combustion chamber, is placed substantially in the axis of the section of the orifice at the issue of the channel of the rotary valve.

When the device according to the invention is applied to a two stroke combustion engine fed by transfer of air via at least one admission port uncovered by the piston just before it passes to the end of the driving stroke, the angular position of the driving of the rotary valve relative to the crankshaft of the engine is adjusted so that, when the combustion chamber is completely swept, the transverse channel of the rotary valve closes in order to prevent losses of fresh gases at exhaust.

The angular position of the driving of the rotary valve by the crankshaft of the engine is adjusted so that the transverse channel of the rotary valve starts to open on the combustion chamber right before the admission port(s) are uncovered by the piston at the end of the power stroke, and the connection of the combustion chamber with the transverse channel of the rotary valve finishes closing right after the admission ports have been covered again by the piston returning to the end of its compression stroke.

According to one very efficient embodiment of the invention, at least inside the transverse flow channel provided in the rotary valve, the longitudinal section of the exhaust system has the general form of a convergent-divergent venturi diminishing the loss of total pressure and/or the thermal transfer of the exhaust gases that can, where necessary, be thus discharged at supersonic speed. The neck of the venturi can be located substantially at the centre of the transverse flow channel provided inside the rotary valve or adjacent to one of the exit edges of this channel.

According to a variation of the invention, the axis of the two orifices is placed substantially in the axis of the cylinder of the engine and is arranged substantially at the center of the combustion chamber provided in the cylinder head. According to another variation, the axis of the two orifices is inclined with respect to the axis of the cylinder of the engine and is arranged on a side of the combustion chamber provided in the cylinder head. The angle of inclination of the two orifices can thus be comprised between 0° and 60° in order to reserve a more favorable place for the spark plug or the injector in the case of diesel engines.

Two stroke internal combustion engines, comprising an exhaust or inlet circuit arranged on the wall of each combustion chamber of the engine can be equipped with a turning rotary valve control device according to the invention, interposed on the circuit adjacent to the wall of the combustion chamber.

According to one embodiment, the exhaust or inlet circuit and its turning rotary valve are realized as a separated assembly that is thereafter fixed to the cylinder head of the combustion chamber, or the part of the exhaust or inlet circuit receiving the rotary valve is manufactured as an integral element of the combustion chamber at its manufacture, for example, by casting and/or machining in the mass in a single piece or several assembled pieces.

Furthermore, one of the main difficulties of realizing internal combustion engines lies in the sealing of the combustion chamber. When, in order to control the inlet circuit or the exhaust of the gases of the combustion chamber, a rotary valve is used that seals the combustion chamber during the high pressure combustion phases, it is advisable to realize a turning joint resistant to high temperatures (600° to 900° C.) and to the chemically aggressive combustion flame.

Numerous sealing systems have been proposed which after a time of service all lead to gripping or sealing defects. To ensure the functioning of the distributor, it is necessary, as described in French Pat. No. 7,014,132, to provide an operating clearance between the rotary distributor and its housing or bore in order to take into account expansion. French Pat. No. 7,105,088 describes a sealing device forming an integral part of the combustion chamber and slidably mounted in a bore perpendicular to the distributor housing. Thus realizing the intersection of the two cylinders. The sealing ring of the device is applied against the rotary distributor by the pressure prevailing in this chamber, which allows an operating clearance between the rotary distributor and the ring sealing.

The known devices present sealing difficulties at high operating temperatures or at cold starting and considerable wear of the sealing joints and contact surfaces of the rotary distributor.

The sealing member according to the invention for a substantially cylindrical rotary valve throughcrossed by at least one channel and on which is applied an annular sealing joint having an axis transversal to the axis of rotation of the rotary valve, in particular to ensure the sealing of an exhaust port of a combustion chamber of an internal combustion engine and in which the annular joint is axially guided in a sealed manner by its external surface which is movable in a bore and applied against the rotary valve by the pressure prevailing in the combustion chamber, is noteworthy in that the contact region between the rotary valve and the joint is lubricated by an oil film maintained despite the pressure of the gases (of the combustion chamber) through-crossing the rotary valve.

The edges of the joint form at each of the ends of the joint contacting the rotary valve, along a plane transverse to the axis of rotation of the rotary valve, an end rib at an angle smaller than 90°. The end rib of the joint, located on the side of the entry in contact with the channel provided in the rotary valve with the annular joint, is provided with a inlet chamfer adapted to form a oil corner that causes the oil film to penetrate between the surfaces at the contact of the rotary valve and the annular joint.

According to another embodiment, in its smallest axial section, the annular joint has an axial height which is near the minimal height ensuring the strength to the pressure of the combustion chamber prevailing inside the joint, so as to ensure good elasticity to apply it against the rotary valve and to improve the holding of the oil film.

The annular joint presents in the axial direction a variable wall thickness the inertia of which at the minimum section is determined to permit the deformation of the joint and its sealing applying against the rotary valve for small overpressures of about 0.1 to 1 bar while ensuring the strength of the joint at bursting under the effect of the pressure of the combustion chamber and the maintenance of the oil film between the joint and the surface of the rotary valve.

According to another embodiment of the joint, its external diameter is comprised between 4/7 and 6/7 of the external diameter of the rotary valve in order to realize a good compromise between the central passage section of the joint, the contact surface with the rotary valve able to improve the holding of the oil film and the curve of the contact region with the rotary valve at the edges of the joint along a plane transverse to the axis of rotation of the rotary valve, this curve reducing the holding of the oil film.

BRIEF DESCRIPTION OF THE DRAWING

Other aims, advantages and characteristics of the invention will appear through reading the description given by way of non limited example of an embodiment of the sealing element, with respect to the annexed drawings in which.

DESCRIPTION OF THE PREFERRED EMBODIMENTS

Figure 1:
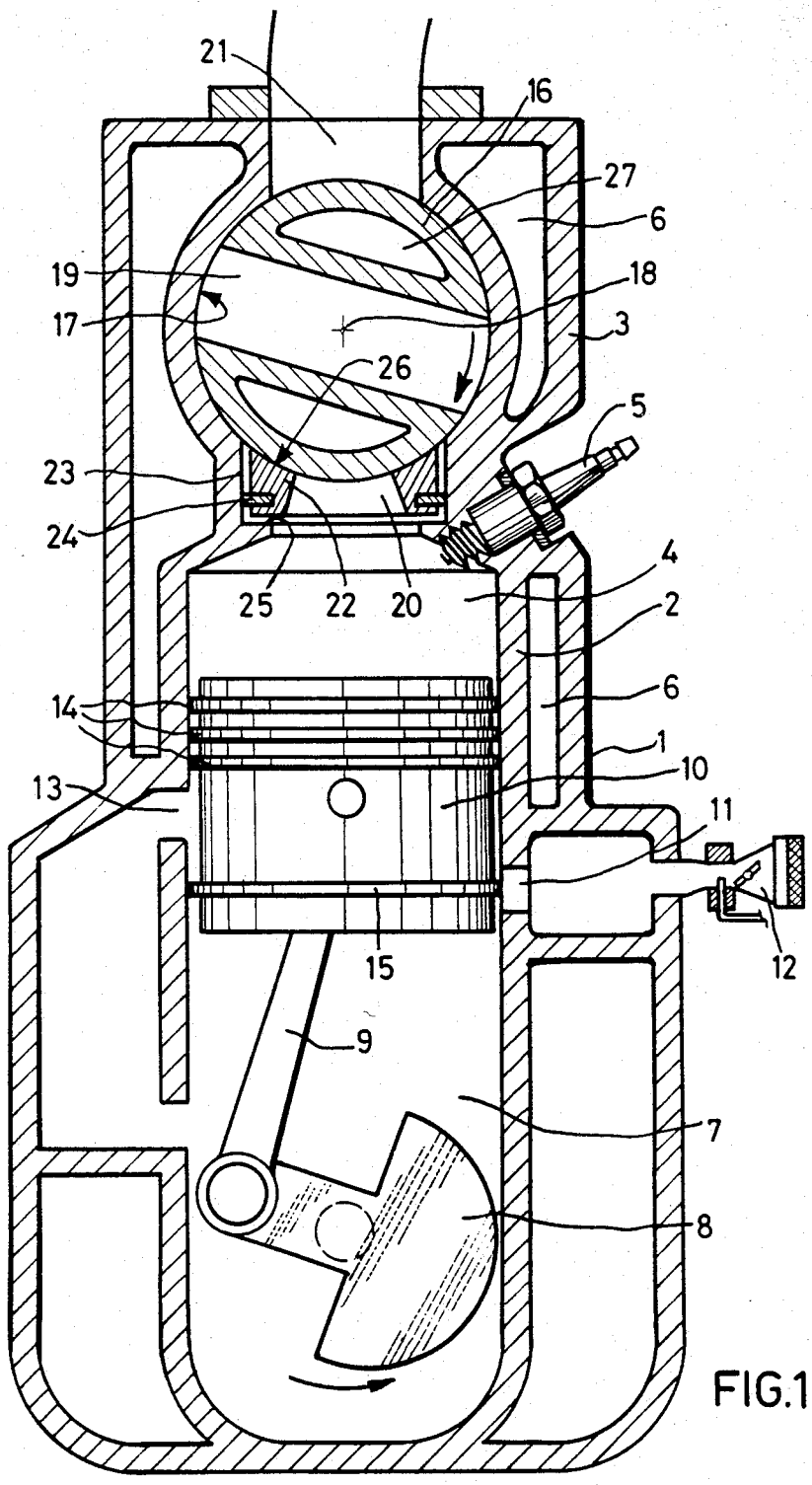
FIG. 1 diagramatically represents a transverse cross section of a single cylinder two stroke engine, equipped with an exhaust control device according to the best mode of the invention, and in which the piston is represented in position of the beginning of the compression of the carburated air sucked into the housing of the crankshaft.

The engine diagramatically represented on FIGS. 1 to 5 comprises the well known elements in two stroke engines. An engine crankcase 1 contains an engine cylinder 2 and is connected to a cylinder head 3, cooled by a circulation of liquid as is cylinder 2, in order to close a combustion chamber 4 into which issues a spark plug 5 or, in the case of diesel engines, a fuel injector.

Cylinder head 3 is represented integral with the crankcase 1, whereas, in reality, it is generally fitted by stud bolts to the engine crankcase 1, while allowing the circulation of the cooling liquid in a cooling circuit 6 common to both crankcase 1 and cylinder head 3.

At the lower part of crankcase 1, is provided a transfer chamber 7 that a crankshaft 8 of the engine connected to a driving rod 9 and to a piston 10 mobile in cylinder 2. This transfer chamber 7, having a minimal volume compatible with the wheel clearance of the crankshaft 8 and driving rod 9, is connected, on the one hand, to an inlet port 11 connected to a filtered air admission, direct in the case of a diesel engine and via a carburetor 12 in the case of an engine fired by spark plug represented on the drawings and, on the other hand, having transfer ports 13 that are especially visible on FIG. 3 at the end of the driving stroke of piston 10. Sealing piston rings 14 of piston 10 uncover ports 13 at the end of the driving stroke of piston 10 in order to authorize the admission of carburated gases, compressed in transfer chamber 7, towards chamber 4 as shown on FIG. 3. A scraping and distribution ring 15 placed on the piston at the part opposite the piston head closing combustion chamber 4, authorizes from a relatively high position of the piston (on FIG. 4 substantially from $\frac{2}{3}$ of the piston stroke towards the end of the driving stroke), the sucked gases to be drawn via inlet port 11 in the transfer chamber 7 put under vacuum by the rise of piston 10.

According to the invention, the exhaust circuit of the engine is controlled in cylinder head 3 by a rotary valve 16 turning in a chamber constituted by a bore 17 with walls of which it is not in contact although its external cylindrical surface is immediately adjacent to the wall of the bore. This rotary valve 16 is driven in rotation by any means, such as a gear train or a chain or a toothed belt, at an angular speed half that of crankshaft 8 of the engine and turns about an axis 18 perpendicular to the axis of cylinder 2. Rotary valve 16 comprises a transverse channel 19 that, during rotation of the rotary valve, opens alternately, on one side, on an orifice 20 connected to combustion chamber 4 and, on the other side, on an orifice 21 connected to the exhaust of the burned gases towards the exterior by any adequate means such as an exhaust pipe. The tightness of rotary valve 16 in the direction of the combustion chamber in which prevails high pressures after firing of the carburated mixture (50 to 60 bars for a two stroke carburetor engine but up to 160 bars for certain over charged diesel engines) is ensured by a metallic sealing ring 22 mobile in a bore 23 open on combustion chamber 4. The tightness of the ring 22 in bore 23 is ensured by at least one elastic resilient ring 24 and the stroke of ring 22 towards combustion chamber 4 is limited by a retention shoulder 25. In fact, the sealing ring that has a front sealing surface 26 corresponding with that of the cylindrical surface of the rotary valve 16, is applied against rotary valve 16 by the pressure prevailing in combustion chamber 4 and acting on its annular section with respect to the pressure prevailing in bore 17 and only slightly above atmospheric pressure.

The axis of orifices 20 and 21 is placed on the figures substantially in the axis of cylinder 2 but it can also be inclined in order to provide a more favorable disposition for the spark plug 5 and to allow the use of a combustion chamber 4 having a wedge form and ensuring a greatest turbulence of the compressed gases and an improved propagation of the firing flame.

Guiding bore 23 of the sealing ring generally has a cross section larger than that of the exhaust orifice 21 to ensure a minimal cross section at the orifice 20 connected to the combustion chamber 4 and to ensure sufficient lubrication on contact of ring 22 with rotary valve 16. Lubrication of the contact between ring 22 and rotary valve 16 can only be maintained by a strong cooling of the rotary valve 16 by a circulation of cooling liquid through-crossing the cavities 27 of the rotary valve and connected to cylinder head 3 by suitable joints adapted to the position of the guiding bearings of rotary valve 16 in cylinder head 3.

The operation of the control device for the evacuation of the exhaust gases will now be explained with respect to FIGS. 1 to 4 on which all the references relating to the elements or parts found in each of the figures have been shown.

It will be seen from FIG. 1 and in the direction of rotation of the crankshaft 8 represented by the arrow parallel to the counterweight of this crankshaft, that piston 10 during its lowering will seal by its scraping ring 15 inlet port 11 in order to compress the fresh carburated gases in transfer chamber 7. Following its stroke downwards, piston 10 uncovers by the first or "firing" ring 14*a*, transfer ports 13 that allow the fresh gases slightly compressed in transfer chamber 7 to be discharged in combustion chamber 4.

Figure 2:
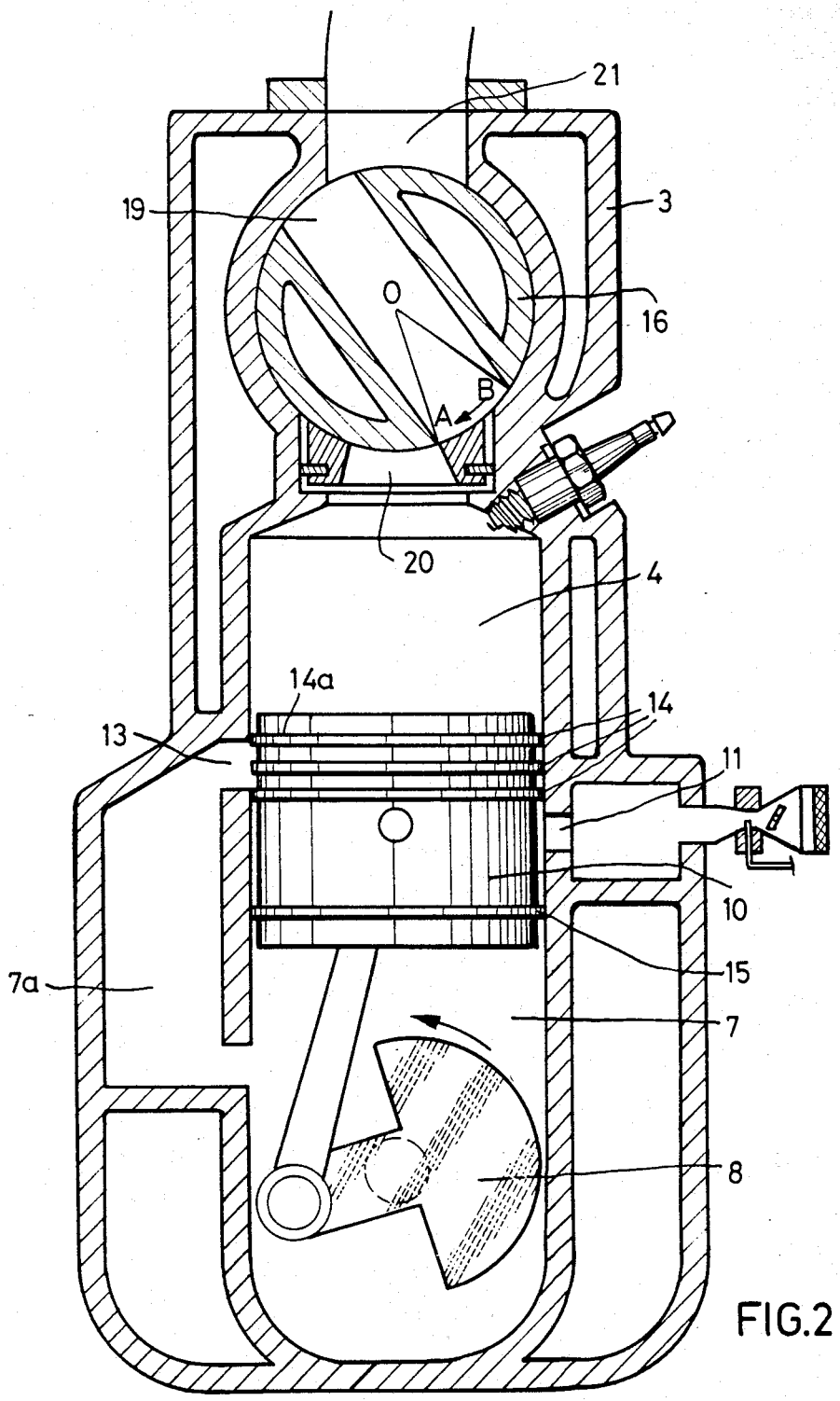
FIG. 2 represents the same engine right before the opening of the exhaust and the uncovering of the fresh gas transfer port in the cylinder.

Immediately prior to the ports 13 being uncovered, rotary valve 16 which has also turned communicates its transverse channel 19, already connected to exhaust orifice 21 (cf. FIGS. 2 and 3) with orifice 20 that communicates with combustion chamber 4. The FIG. 2 shows the motor at the time when the inlet rib A of cylindrical channel 19 opens on orifice 20 before the "firing" ring 14*a* opens the communication between ports 13 and combustion chamber 4.

Figure 3:
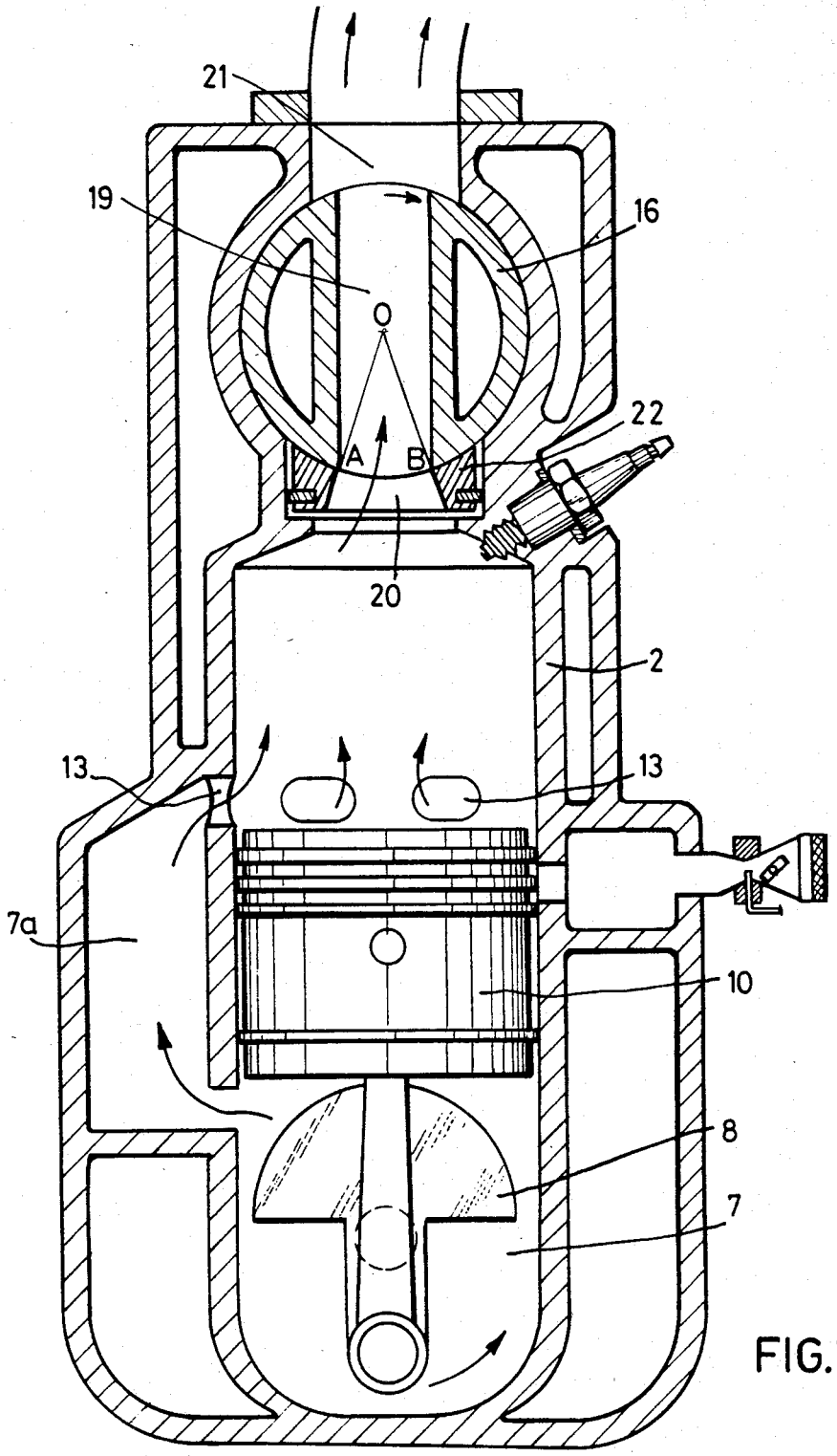
FIG. 3 diagramatically represents the engine at the end of the driving stroke.

At the instant before ports 13 are significantly open under the effect of the relatively high pressure prevailing in the combustion chamber 4 (of about 10 bars for a two stroke engine at full admission) at the openinhg of orifice 20 on channel 19, a considerable part of the burned gases are already discharged in the exhaust. The overpressure still prevailing in the combustion chamber 4 possibly compresses by ports 13 part of the fresh gas in transfer channel *7a* existing between main transfer chamber 7 containing crankshaft 8 and ports 13. The movement of piston 10 continues until the end of the driving stroke shown on FIG. 3, the pressure in the transfer chamber continues to increase whereas the pressure in the cylinder 2 and combustion chamber 4 rapidly diminishes through the wide passage section of the transverse channel 19 that, on FIG. 3, is placed at the end of the driving stroke, exactly in the axis of cylinder 2 and orifice 20. FIG. 3 shows that the transverse section of channel 19 is substantially equal to the section of the orifice 20 provided in the sealing ring 22 on contact of the external cylindrical surface of the rotary valve 16 and the inlet A and exit B ribs of channel 19 thus substantially corresponding to the end of the driving stroke of piston 10 with corresponding ribs of orifice 20 open on the combustion chamber.

Figure 4:
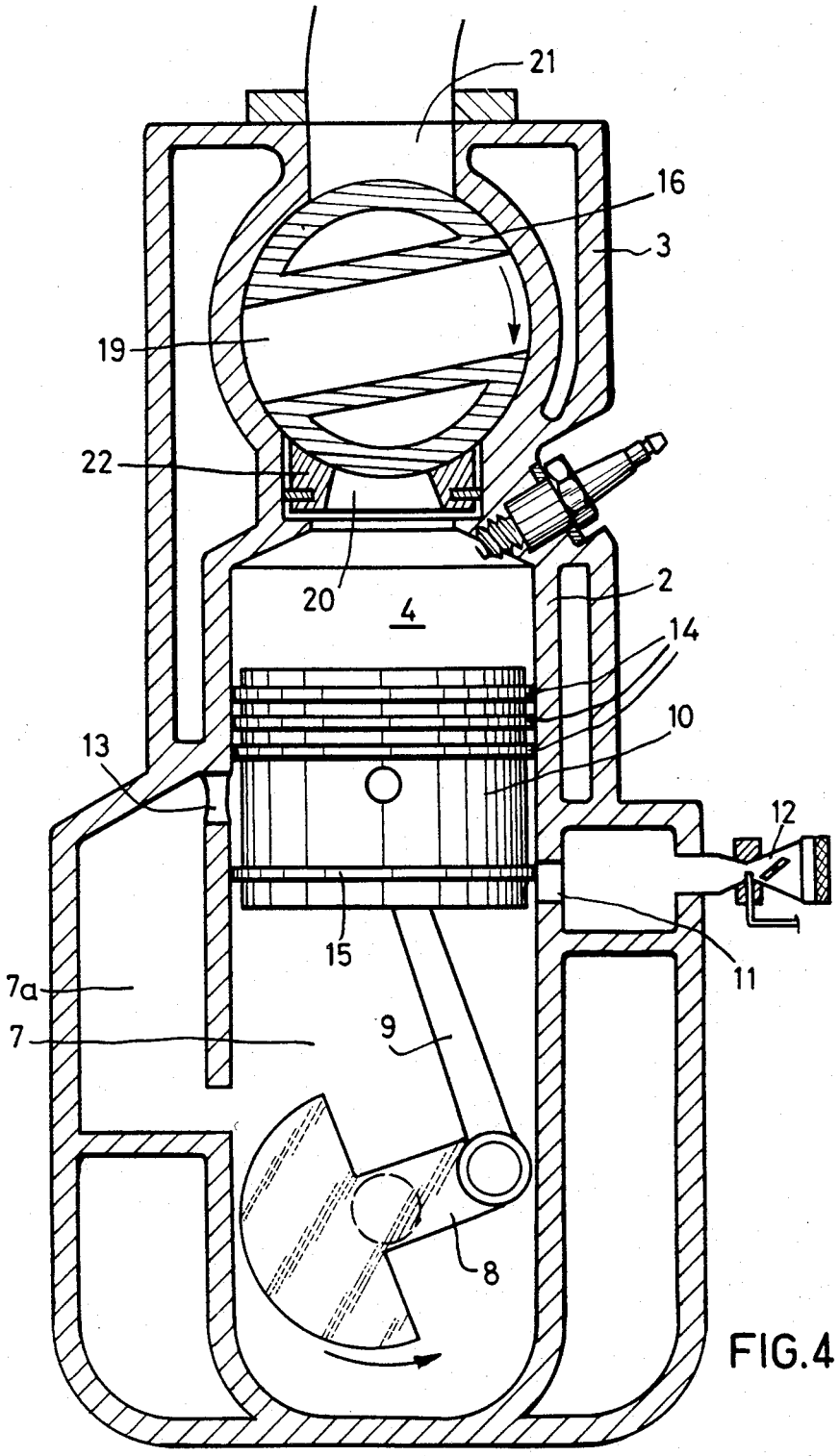
FIG. 4 represents the engine at the moment when the piston, in the compression phase of the combustion chamber, uncovers the admission port for fresh gases in the housing of the crankshaft.

FIG. 4 shows that after the passage at the end of the driving stroke, piston 10 rises again to the compression position and rings 14 have sealed transfer ports 13, while the rotation chamber of rotary valve 16 seals orifices 20 and 21 isolating the combustion chamber from the exhaust.

It should be noted that according to an important design of the invention, exhaust orifices 20, 19, 21 are disposed in cylinder 2 opposite the admission ports 13 and the fresh gases channeled through ports 13 in slight overpressure can repulse the burned gases before them in the direction of the exhaust. This repulse effect "without mixture" of the exhaust gases is furthermore strengthened by the depression effect on the exhaust gas that provoke certain exhaust circuits whose own frequency is in harmony with the rotation frequency of the engine.

At the instant of the cycle shown on FIG. 4, the scraping ring 15 uncovers the inlet port 11 which connects the carburetor 12 to the transfer chamber 7 in slight depression under the effect of the rise of the piston 10 towards the end of the compression stroke. During the rise of the piston 10 towards the end of the compression stroke, the depression in the transfer chamber 7 is maintained despite the contribution of fresh gas and the inertia of the gas column between the carburetor 12 and the transfer chamber 7 allows the continuation of the filling up of chamber 7 by a mechanical hysteresis effect until the instant when, after the end of the compression stroke of piston 10 and firing of the carburated mixture compressed in the combustion chamber 4, the piston 10 moves downwards and again seals by scraping ring 15 the inlet orifice 11, according to the position represented on FIG. 1. During displacement of the piston 10, the mechanical connection between crankshaft 8 and rotary valve 16 continues to drive the valve in rotation so as to perform a half-turn during a rotation cycle of the engine and the other outlet from channel 19 fulfills in turn the opening and closing functions by cooperating with the sealing ring 22.

Figure 5:
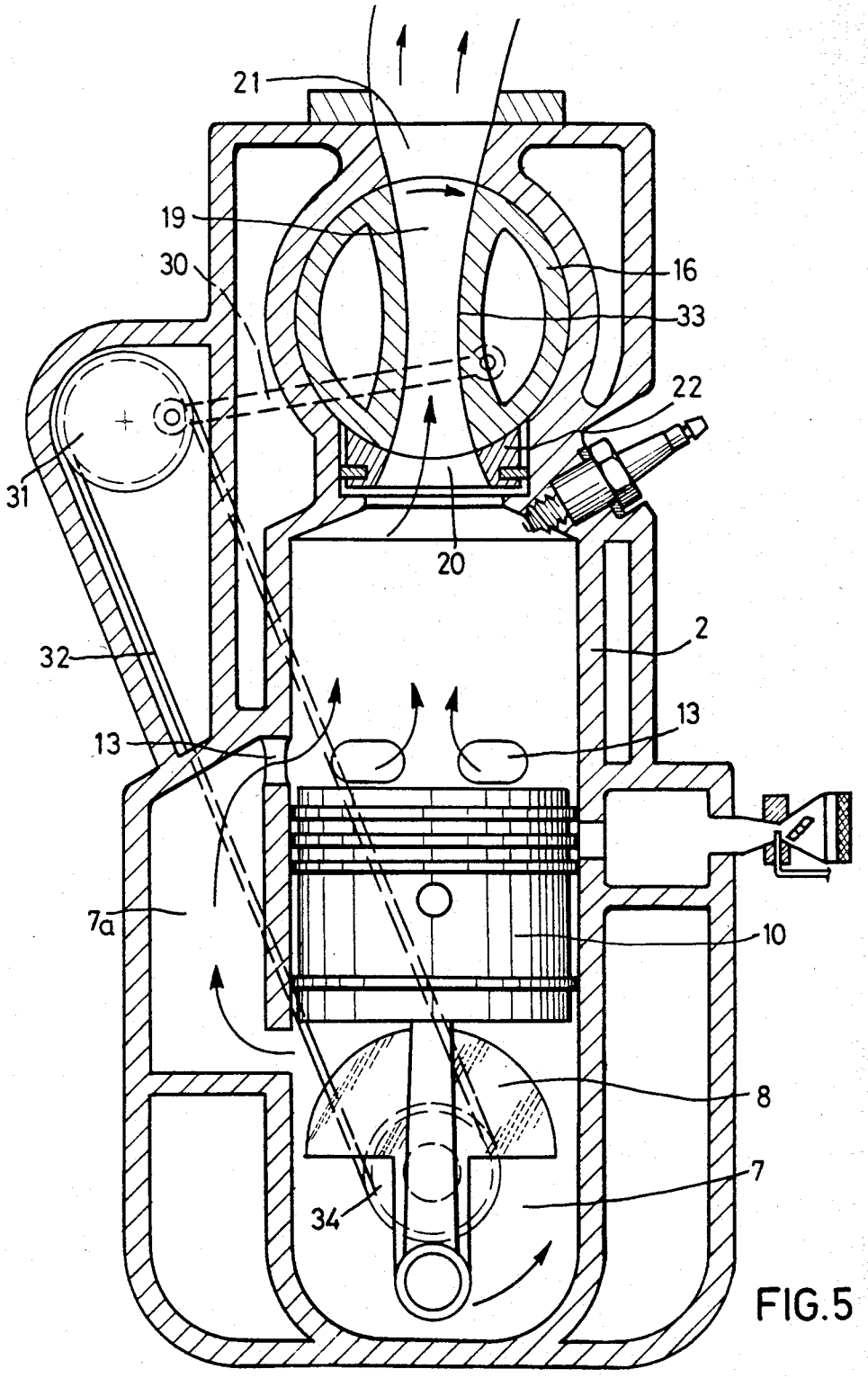
FIG. 5 represents the engine according to a variant in which the rotary valve for the control of the exhaust performs an alternate oscillating rotation movement.

According to the embodiment shown on FIG. 5, two variants have been made to the engine represented on FIGS. 1 to 4. Rotary valve 16 is driven in an oscillating rotation movement synchronized with the rotation of crankshaft 8 by the means of driving rod 30 coupled to crankshaft 8 by a pulley or intermediary wheel 31 mechanically connected to this crankshaft 8 by a chain or a toothed belt 32. Driving rod 30 is coupled by crankpins at each of its ends, respectively to pulley 31 and to rotary valve 16 that can thus remain in its maximum opening position during a longer period due to the fact of the passage at the end of the compression stroke of the crank-pin of driving rod 30 coupled to the pulley 31 when channel 19 is wide open on the combustion chamber 4.

According to another improvement of this embodiment, the longitudinal cross section of the channel 19 eventually coupled with the internal bore of ring 22 and the cross-section of the exhaust 21, have the general form of a convergent-divergent venturi the neck 33 of which is situated herein substantially at the center of channel 19, but can be positioned adjacent to the exit edges of this channel if the cross-section of the exhaust circuit thus allows it. For sufficient exhaust gas pressures, the flow in the divergent part can reach supersonic speeds and the exhaust noise, the thermal transfers and loss of total pressure are notably reduced whatever the exhaust pressure.

Of course, the embodiment described above is adaptable to numerous variations available to the man skilled in the art, according to the applications envisaged and without departing from the spirit of the invention.

Thus, the exhaust control system that is described in combination with a two stroke internal combustion engine could be applied to a two or four stroke engine in order to replace the exhaust and/or inlet air valves in the cylinder. It is also possible to use other adjustments for the position of the transverse channel with respect to the various positions of the piston 10. This channel 19 can also be constituted by two openings having a relatively reduced section issuing into a central part having a larger section in order to realize a preexpansion chamber for the exhaust gases in rotary valve 16.

Orifices 20 and 21 as well as the section of channel 19 can have a circular shape but are more advantageously rectangular or square (with truncated angles, for example).

Orifice 20 can issue into any given point of the wall of the combustion chamber 4 and can also constitute the admission of the fresh gases into the combustion chamber 4. Furthermore, it should be understood that the inlet ports can be fed by any means other than the overpressure in the transfer chamber 7 that can be filled with compressed air by the compressor of a turbocompressor or a blade pump. One important advantage of the dispositions according to the present invention resides in the fact that the sealing ring 22 is applied on the rotary valve 16 by the single pressure prevailing in the combustion chamber 4 which, for high compression engines such as diesel engines can, at the end of the compression stroke of the piston 10, be reduced to the internal space of the ring 22, the fuel injection being carried out by using an injector delivering a sheet of pulverized combustible substantially parallel to the upper surface of the piston 10 or to the inlet section of the ring 22 on the side of the combustion chamber 4.

As a variant, driving rod 30 of FIG. 5 could be directly connected to the pulley or the wheel of the crankshaft 34. Channel 19 can also, in certain versions, be replaced by a lateral slot provided on the side of the rotary valve and communicating a lateral exhaust 21 with the combustion chamber 4 and alternatly, where necessary, with the admission of fresh gas.

FIGS. 6 to 9 show the rotary valve or distributor 101 in the form of a rotary valve (FIG. 6) supported by smooth rollers or bearings and turns inside the bore 102 of a housing or stator 101*a* with an operating clearance preventing any contact with the walls of the bore despite the differential expansion that the passage of the hot gases can provoke. The direction of rotation of the rotor is indicated by an arrow adjacent to the periphery of the distributor 101.

The sealing element 103 is used for ensuring the tightness of a combustion chamber 104 of an internal combustion engine. This element is freely mounted and slides with a large operating clearance in a bore 105 perpendicular to the groove 102 of the housing or stator and that presents a little conicity the point of which is directed towards the combustion chamber 104. The peripheral sealing of element 103 constituting an annular ring is ensured by one or several resilient sealing rings 106. The passage of the exhaust gases of the combustion chamber 104 towards the exhaust is carried out through a transverse passage 107 provided in the distributor and the central orifice 107*a* of the annular ring 103. During operation of the thermal engine, the rotary distributor 101 and its sealing element 103 are subject to diverse mechanical and thermal constraints provoked by:

the difference of average temperature between the distributor 101 and the sealing element 103 that receives the "firing shot" of the exhaust gases and evacuates a large part of the received heat by its surface in contact with the distributor 101;

the fact that the materials in which are realized the distributor 101 and the sealing element 103 are different in order to preserve good rubbing and thermal properties, the sealing element is generally realized in cast iron having a thermal expansion coefficient substantially half of that of the aluminium alloy in which is realized the distributor 101 and its housing 101*a;* the geometric deformations of the distributor due to its form, to the thermal expansion, to the mechanical constraints provoked by its rotation and the centrifugal force.

The parameters above produce the result that the radius of curvature OA of the distributor and the radius of curvature OB of the rubbing surface of the sealing element 103, that must continuously coincide, are deformed, mainly under the effect of the thermal shock of the alternate blasts of exhaust gas from the motor.

The sealing element according to the invention is realized so that its inertia at its minimal section, along a cut plane 108 (cf. FIG. 7) allows it a large amount of flexibility in order that, from the application of an even low gas pressure (the beginning of engine compression) in the combustion chamber 104, the radius of curvature OB of the element can coincide to the radius of curvature OA of the distributor by the flexing of element 103 even for substantial differences between these two radii OA and OB and ensure the permanent contact allowing tightness.

Figure 8:
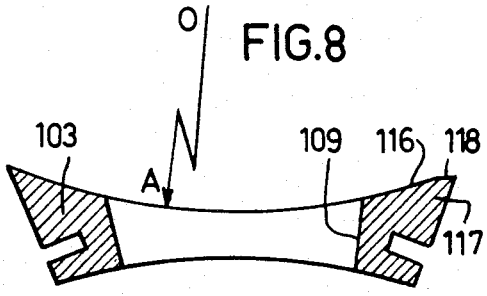
FIG. 8 shows, in an exagerated manner by way of illustration and on a large scale, a transverse cross section of the sealing element when it is deformed by friction heating and/or contact wear with the surface of the rotary valve.

FIG. 8 represents the deformation of the ring sealing 103, mainly under the effect of heating on rubbing contact with the distributor 101. The radius of curvature OA of the distributor is larger than the radius of curvature OB of the sealing element. Under the effect of applying pressure, element 103 is deformed towards the exterior so that OA is equal to OB. On FIG. 9, the radius of curvature of the distributor OA is smaller than the radius of curvature OB of the element 103 not subject to the pressure. Under the effect of the pressure of the combustion chamber 104, the sealing element 103 is deformed towards the interior so that OA is equal to OB.

It must be noted that the application of the pressure to the interior of the orifice of the passage 107*a* of the sealing element 103 tends to provoke bursting of the element by creating a maximum stress in its minimal section, along a cut plane 108 (FIG. 7) which must be sufficient in order that the stress in this minimal resistance region is compatible with the mechanical characteristics and resistance of the material used for the annular sealing element 103.

It thereafter appears evident that the best results will be obtained with materials having low moduli of elasticity and good elongation and flexing characteristics and such as steel or cast iron for piston resilient rings.

The pressure prevailing inside the orifice 107*a* of the sealing orifice 103 tends to curve it according to FIG. 8 in which the radius of curvature OB is larger than the final radius OA due to the reaction of the geometry of the joint at the efforts of pressure on the internal walls 109 of the orifice 107*a*.

In order to favor cold starting, an initial radius of curvature OB is preferably chosen at the machining of the sealing element that is smaller than the initial radius of curvature OA at machining of the distributor 101.

The clearance between the sealing element 103 and its bore 105 must be sufficient to accept the deformations of conformability without jamming harmful for its correct operating and be chosen in function of the thorough study of all the cases able to be met in operation.

Figure 7:
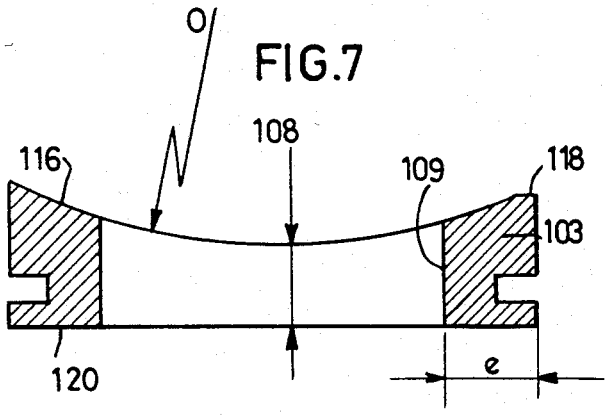
FIG. 7 represents a transverse section of the sealing element on a larger scale showing its minimal section.
Figure 9:
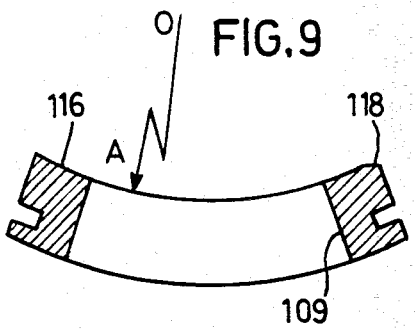
FIG. 9 represents, also on a large scale, a transverse cross-section of the sealing element when it is in an exagerated manner deformed by the exhaust gases.

According to the invention, various steps are applied to the annular joint 103 in order to maintain a continuous oil film under the surface contact between the external cylindrical surface 115 of the distributor 101 and the conjugated surface 116 provided on the ring sealing (FIGS. 7 to 9).

Among these steps, it is possible to forsee on the end rib 117 of the joint (cf. FIG. 7) situated on the side of the inlet of the contact at the outlet of the channel 107 (referenced 114 on FIG. 6) with the annular joint, an inlet chamfer 118 that forms an oil corner at the inlet of the sealing surfaces in contact. A source of oil pressure, or for two stroke engines simply the condensation of the oil transported by the exhaust gases feeds a zone permanently connected to an exhaust pipe 119 towards the exterior. The oil discharged in this area, limited by the sealing rings 116 of the joint 103 in the rod 105, is carried into the annular space 113 comprised between the surface of the housing 102 and the external surface 115 of the distributor 101 and is accumulated in the oil corner formed by the chamfer 118.

In order to maintain the oil film interposed between the distributor 101 and the metallic annular joint 103 when the temperature of the exhaust gases deforms the parts in contact, it is necessary to foresee a large elasticity between these parts so that the pressure prevailing in the combustion chamber 104 completely seals the joint 103 to the distributor 101.

With this aim, the minimal section 108 of the joint 103 is reduced to the smallest height possible allowing it to resist the effects of the pressure prevailing in the passage 107*a* and which tends to cause to burst radially the joint 103. Furthermore, the thickness e of the joint 103 is comprised between 1/10 and ⅛ of the external diameter of the distributor 101 in order to realize a good compromise between the effects of the pressure applied on the joint in the direction of the rotary valve, the section of the joint applied on the rotary valve through the intermediary of the oil film and the deformation of the joint under the effect of the pressure of the gas from the combustion chamber that it through-crosses.

The external diameter of the element 103 and of the bore 105 that guides it can be comprised between 4/7 and 6/7 of the external diameter of the rotary valve 101 in order to realize a good compromise between the central section of passage of the joint, the surface of contact with the rotary valve adapted to improve the holding property of the oil film and the curve of the contact zones with the rotary valve at the edges of the joint along a plane transverse to the axis of rotation of the rotary valve, this curve being itself able to diminish the holding property of the oil film.

Of course, the realization of the sealing member according to the present invention is not limited to the embodiments described and represented herein-above and it is adaptable to numerous variants available to the man skilled in the art, without departing from the spirit of the present invention.

Therefore, the axial clearance between the plane base 120 of the joint 103 and the bearing face 112 provided in the housing 101*a* that contains the distributor 101 must be reduced to a minimum compatible with the dilatations of this housing 101*a* of the joint 103 and the distributor 101, i.e. for current dimensions of two stroke engines, to dimensions of about 5/20 millimeters.

Figure 6:
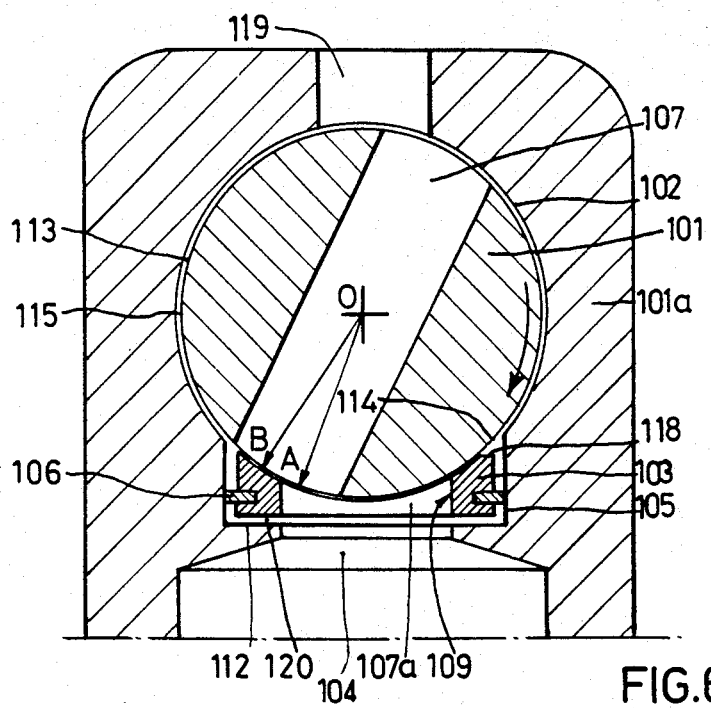
FIG. 6 represents a transverse section of a rotary distributor equipped with the sealing element or member according to the invention.

Furthermore, it must be understood that the permanent application of the sealing element 103 on the distributor 101 in the form of a rotary valve is ensured without the presence of a return spring due to the slight conicity of the bore 105 that tends to repulse by a kind of mecano-pneumatic effect the joint 103 in the direction of the rotary valve 101 with regard to the gravity acting on the element 103 when the sealing element is placed, according to FIG. 6, at the head of the combustion chamber.

Furthermore, the element 103 can present an external diameter very close to that of the bore 105 so that during its diametral swelling under the action of the pressure of the combustion chamber 104, it bears on the wall of this groove which allows to limit the risks of bursting.

We claim:

1. A control device for the evacuation of exhaust gases from a combustion chamber of an internal combustion engine, comprising rotary valve means including a transverse flow channel, the rotary valve means performing one of a continuous and oscillating turning movement synchronized with a rotation of a crankshaft of the engine, so that the channel is periodically positioned in communication on one side thereof with a first orifice directly connected to the combustion chamber and, on another side thereof, with a second orifice connected to an exhaust port for emitting burned gases from the combustion chamber, and during remaining times to seal the orifices, in synchronization with the respective phases of compression, the rotary valve means being contained in a first bore into which issues the first orifice directly connected to the combustion chamber and the second orifice connected to the exhaust port, the first orifice connected to the combustion chamber being arranged within annular sealing means housed in a second bore and said annular sealing means contacting the rotary valve means by the pressure prevailing in the combustion chamber and including at least one resilient annular sealing element, said at least one annular sealing element being able to slide in the second bore and its travel distance being limited, on one side thereof, by the rotary valve means and, on another side thereof, by a retaining shoulder, and the rotary valve means including at least one cavity surrounding its transverse flow channel for the circulation of a cooling fluid.

2. A control device according to claim 1, wherein the rotary valve means is driven at an angular speed of rotation equal to half the angular speed of the crankshaft of the engine.

3. A control device according to claim 1, wherein the rotary valve means is driven in an alternate oscillating rotation movement at each turn of the engine, and further comprising mechanical coupling means including a driving rod having a first end driven in rotation by the crankshaft of the engine, and another end connected to the rotary valve means.

4. A control device according to claim 1, wherein a section of the first orifice provided within the annular sealing means at the contact of the rotary valve means is placed substantially coaxial with the channel at the end of the power stroke of a piston closing the combustion chamber.

5. A control device according to claim 1, applied to a two cycle combustion engine fed by transfer of air via at least one admission port uncovered by a piston just before it passes to the end of its power stroke, wherein the angular position of the rotary valve means relative to the crankshaft of the engine is adjusted so that when the combustion chamber is completely swept, the transverse flow channel of the rotary valve means closes in order to prevent exhaust of fresh gases.

6. A control device according to claim 5, wherein said engine further includes at least one admission port for fresh gases associated with said combustion chamber, and the angular position of the rotary valve means relative to the crankshaft of the engine is adjusted so that the transverse flow channel of the rotary valve means starts to open on the combustion chamber immediately prior to at least one admission port being uncovered by the piston reaching the end of its power stroke.

7. A control device according to claim 5, wherein said engine further includes at least one admission port for fresh gases associated with said combustion chamber, and angular position of the rotary valve means relative to the crankshaft of the engine is adjusted so that connection of the combustion chamber with the transverse flow channel of the rotary valve means finishes closing immediately after at least one admission port being uncovered by the piston rising again towards the end of its compression stroke.

8. A control device according to claim 1, wherein at least the transverse flow channel provided in the rotary valve means has a longitudinal section with the general form of a convergent-divergent venturi diminishing the loss of total pressure and/or thermal transfer of exhaust gases, the venturi having a neck located on an outlet of said transverse flow channel.

9. A control device according to claim 1, wherein the two orifices are placed substantially coaxially with the axis of a cylinder of the combustion chamber and the first orifice issuing substantially centrally of the combustion chamber.

10. A control device according to claim 1, wherein said internal combustion engine includes a plurality of combustion chambers formed by respective walls and an exhaust circuit issuing to the wall of each combustion chamber of the engine, and said control device includes said rotary valve means associated respectively with each combustion chamber and positioned adjacent to the wall of the respective combustion chamber.

11. A control device according to claim 10, wherein each exhaust circuit and its turning rotary valve means are realized as a separate assembly fixed to a cylinder head in the combustion chamber.

12. A control device according to claim 10, wherein at least part of the exhaust circuit receiving the rotary valve means is manufactured as an integral element of the combustion chamber at its manufacture.

13. A control device according to claim 1, wherein at least one resilient annular sealing element is axially guided in a sealed manner by an external surface thereof which is movable in the second bore, said at least one resilient annular sealing element being applied against the rotary valve means by pressure prevailing in the combustion chamber, and the second bore has a slight conicity, the apex of which is directed towards the combustion chamber to permanently return the at least one sealing element in the direction of the rotary valve means and wherein the contact zone between the rotary valve means and the at least one sealing element is lubricated by an oil film maintained despite pressure of gases in the combustion chamber that cross through the rotary valve means.

14. A control device according to claim 13, in which edges of each sealing element form at each of their ends contacting the rotary valve means, along a plane transverse to the axis of rotationof the rotary valve means, an end face under an angle smaller than 90°, wherein the end face of each sealing element in contact with the rotary valve means is provided with an inlet chamfer which forms an oil corner that causes the oil film to penetrate between the contacting surfaces of the rotary valve means and each respective annular sealing element.

15. A control device according to claim 13, wherein in its smallest axial section, the at least one annular sealing element has an azial height which is near a minimal height to ensure resistance to pressure of the combustion chamber prevailing inside the at least one element, whereby to ensure a good elasticity when applied against the rotary valve means and to improve the behavior of the oil film.

16. A control device according to claim 13, wherein the at least one annular sealing element presents in the axial direction a variable wall thickness and the inertia of which at the minimum wall thickness is determined to permit deformation of the at least one element and to provide a seal applied against the rotary valve means for small overpressures of about 0.1 to 1 bar while ensuring strength against bursting under the effect of pressure of the combustion chamber and maintaining the oil film between the at least one sealing element and the surface of the rotary valve means.

17. A control device according to claim 13, wherein the external diameter of the at least one annular sealing element is in the range of between 4/7 and 6/7 of the external diameter of the rotary valve means in order to realize a good compromise between the second orifice connected to the exhaust, a surface of the at least one sealing element contacting the rotary valve means for improving the maintenance of the oil film and the curve of zones contacting the rotary valve means at the edges of the at least one sealing element along a plane transverse to the axis of rotation of the rotary valve means, this curve reducing the maintenance of the oil film.

* * * * *